US006540300B2

(12) United States Patent
Piretti

(10) Patent No.: US 6,540,300 B2
(45) Date of Patent: Apr. 1, 2003

(54) ARMREST FOR CHAIR, ARMCHAIR OR SIMILAR, A CHAIR USING SAID ARMREST

(75) Inventor: Giancarlo Piretti, Bologna (IT)

(73) Assignee: Pro-Cord S.p.A., Bologna (IT)

( * ) Notice: Subject to any disclaimer, the term of this patent is extended or adjusted under 35 U.S.C. 154(b) by 0 days.

(21) Appl. No.: 09/873,378

(22) Filed: Jun. 5, 2001

(65) Prior Publication Data

US 2002/0043862 A1 Apr. 18, 2002

(30) Foreign Application Priority Data

Jun. 6, 2000 (IT) ..... TO20000A539

(51) Int. Cl.[7] ..... A47C 7/54

(52) U.S. Cl. ..... 297/411.35; 297/411.36; 297/411.37

(58) Field of Search ..... 297/411.36, 411.35, 297/411.37, 411.38

(56) References Cited

U.S. PATENT DOCUMENTS 5,265,938 A * 11/1993 Melhuish et al. ..... 297/411.36
5,318,347 A * 6/1994 Tseng ..... 297/411.36
5,368,365 A * 11/1994 Feldberg ..... 297/411.36
5,382,079 A * 1/1995 Wilson et al. ..... 297/411.35 X
5,388,892 A * 2/1995 Tornero ..... 297/411.36
5,415,459 A * 5/1995 Schultz ..... 297/411.37
5,435,626 A * 7/1995 Lai ..... 297/411.36
5,439,267 A * 8/1995 Peterson ..... 297/411.36
5,590,934 A * 1/1997 Gibbs ..... 297/411.35
5,620,233 A * 4/1997 Corwin ..... 297/411.36
5,641,203 A * 6/1997 Van De Riet et al. .. 297/411.36 X
5,651,586 A * 7/1997 Groth ..... 297/411.37
5,664,842 A * 9/1997 Tseng ..... 297/411.38
5,876,097 A * 3/1999 Cao ..... 297/411.35 X
5,927,811 A * 7/1999 Tseng ..... 297/411.35 X
5,971,484 A * 10/1999 Lamart et al. ..... 297/411.35 X
6,017,091 A * 1/2000 Cao ..... 297/411.35 X
6,045,191 A * 4/2000 Piretti ..... 297/411.35 X
6,059,366 A * 5/2000 Hu ..... 297/411.35
6,062,647 A * 5/2000 Mei ..... 297/411.36 X
6,209,840 B1 * 4/2001 Chen ..... 297/411.36 X
6,209,961 B1 * 4/2001 Chen ..... 297/411.35 X
6,336,680 B1 * 1/2002 Lee ..... 297/411.36
6,343,839 B1 * 2/2002 Simons, Jr. et al. 297/411.37 X
6,343,840 B1 * 2/2002 Chuang ..... 297/411.36
6,398,309 B1 * 6/2002 Chen ..... 297/411.36

FOREIGN PATENT DOCUMENTS

DE 4317610 A1 * 12/1994 ..... 297/411.38

* cited by examiner

*Primary Examiner*—Peter M. Cuomo
*Assistant Examiner*—Rodney B. White
(74) *Attorney, Agent, or Firm*—Sughrue Mion, PLLC

(57) ABSTRACT

An armrest of a chair which can be adjusted and which can be moved in a transverse horizontal direction with respect to the longitudinal direction of the armrest. Regardless of the position thus obtained, the armrest is capable of turning on an essentially vertical axis between two extreme positions, so to adapt to the specific needs of the user and to the activities to be performed in an optimal way.

13 Claims, 6 Drawing Sheets

ARMREST FOR CHAIR, ARMCHAIR OR SIMILAR, A CHAIR USING SAID ARMREST

BACKGROUND OF THE INVENTION

This invention relates to armrests for chairs, armchairs or similar of the type comprising a supporting column and an armrest body connected to the upper extremity of the supporting column.

Particularly in the case of office chairs, a known type presents a mobile armrest in a transverse horizontal direction with respect to the longitudinal direction of the armrest, so to adapt the position of the armrest to the specific requirements of the users and also to the different activities, which the user can carry out. For example, working at the keyboard of a typewriter or computer requires a respectively relative close position of the two armrests of the chair for the purpose of suitably supporting the wrists of the user during work. Conversely, a relaxing position, with the back resting on the backrest of the chair, preferably requires a respectively more distanced positioned of the two armrests. The solutions proposed to date do not always satisfy said needs adequately and, moreover, do not account for the additional need for the user to have a suitable support of the forearms in all the possible positions they can assume.

SUMMARY OF THE INVENTION

The purpose of this invention is to attain an armrest, which is capable, on one hand, to efficiently solves all said problems, and which, on the other hand, presents a relative simple, cost-effective structure.

In order to attain this purpose, this invention relates to an armrest of the type illustrated at the beginning of this description, characterised in that:

- the armrest body pivots on a first axis, which is essentially vertical on an intermediate supporting element and can assume various angular positions around said first axis,
- the intermediate supporting element is connected to the armrest supporting column so to move in a direction, which is essentially transverse and horizontal with respect to the longitudinal direction of the armrest, so that the latter can also be positioned in various operative positions with respect to the supporting column, transversely with respect to the longitudinal direction of the armrest.

Thanks to these characteristics, the user sitting in a chair provided with two armrests according to this invention can easily space out or bring nearly the two armrests, according to the users preferences or requirements. At the same time, for each transversal position, the armrest can be oriented on said first essentially vertical axis, in such a way to provide a suitable support to the respective forearm, regardless of the position of the latter on the horizontal plane.

According to an additional characteristic of the armrest according to the invention, positioning devices for defining at least two extreme angular positions of the armrest body, turned in opposite directions around said first vertical axis, in addition to an unturned neutral position, are arranged between the armrest body and the intermediate supporting element.

Furthermore, in the preferred form of embodiment of this invention, said intermediate supporting element is connected to the supporting column by means of an articulated vertical axis parallelogram linkage system, which can pivot between two opposite extreme positions. Preferably, the articulated parallelogram linkage system comprises a pair of arms, articulated both on two vertical axes on the supporting column and on two vertical axes of said intermediate supporting element.

In this description and in the claims that follow, the term "vertical" is used with reference to a normal horizontal condition of the armrest. However, the armrest according to this invention can also be used in a chair described in a co-pending patent application by the Applicant, in which the backrest can recline backwards along with the supporting column of each armrest. In the reclined condition, said first axis, on which the armrest body can pivot, is no longer vertical, but remains in any case perpendicular to the general plane of the armrest body.

Always in the case of this preferred form of embodiment, the reference devices of the first angular operative angular position on said first axis comprise an engaging element connected to the intermediate supporting element, which is made to co-operate with an elastic element connected to the armrest body and with several reception housings of the engaging element for defining various operative angular positions of the armrest around said first axis.

According to an additional preferred characteristic of this invention, said supporting column can be adjusted in length, to allow adjusting the height of the armrest body. For this purpose, the supporting column comprises an internal tube destined to be connected to an element belonging to the structure of the chair, and an external tube fitted so to slide around the internal tube and can be blocked in any position between a plurality of various operative positions, by means of fastening devices which can be released manually.

BRIEF DESCRIPTION OF THE DRAWINGS

This invention will be better explained by the following detailed descriptions with reference to the accompanying figure as non-limiting example, whereas.

DETAILED DESCRIPTION OF THE INVENTION

Figure 1:
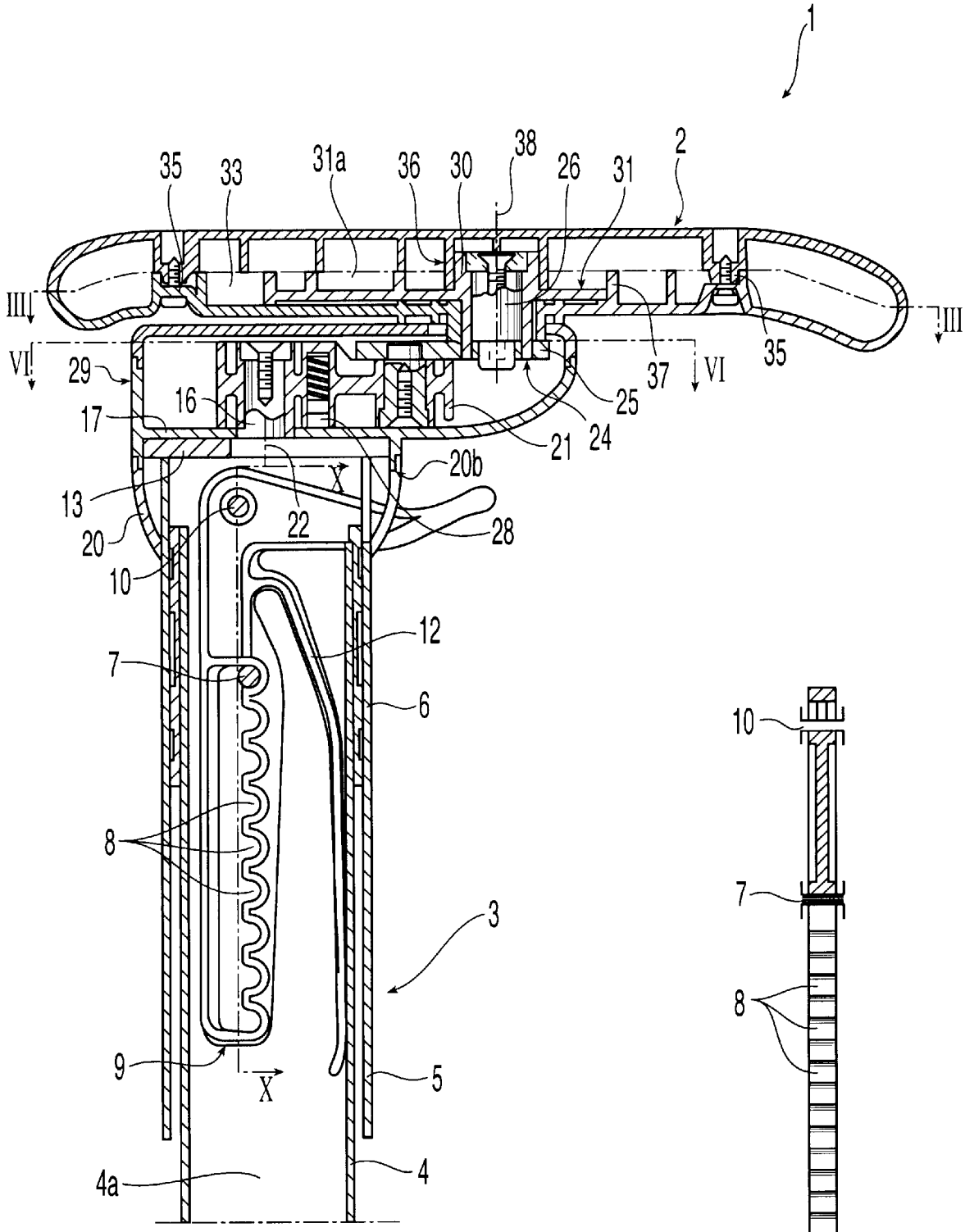
FIG. 1 is a lateral cross-section view of a preferred form of embodiment of the armrest according to this invention.
Figure 10:
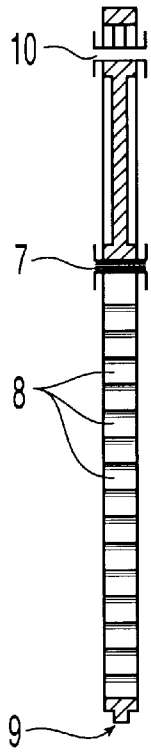
FIGS. 10, 11 and 12 illustrate a blown-up view of three details of the armrest according to this invention.
Figure 2:
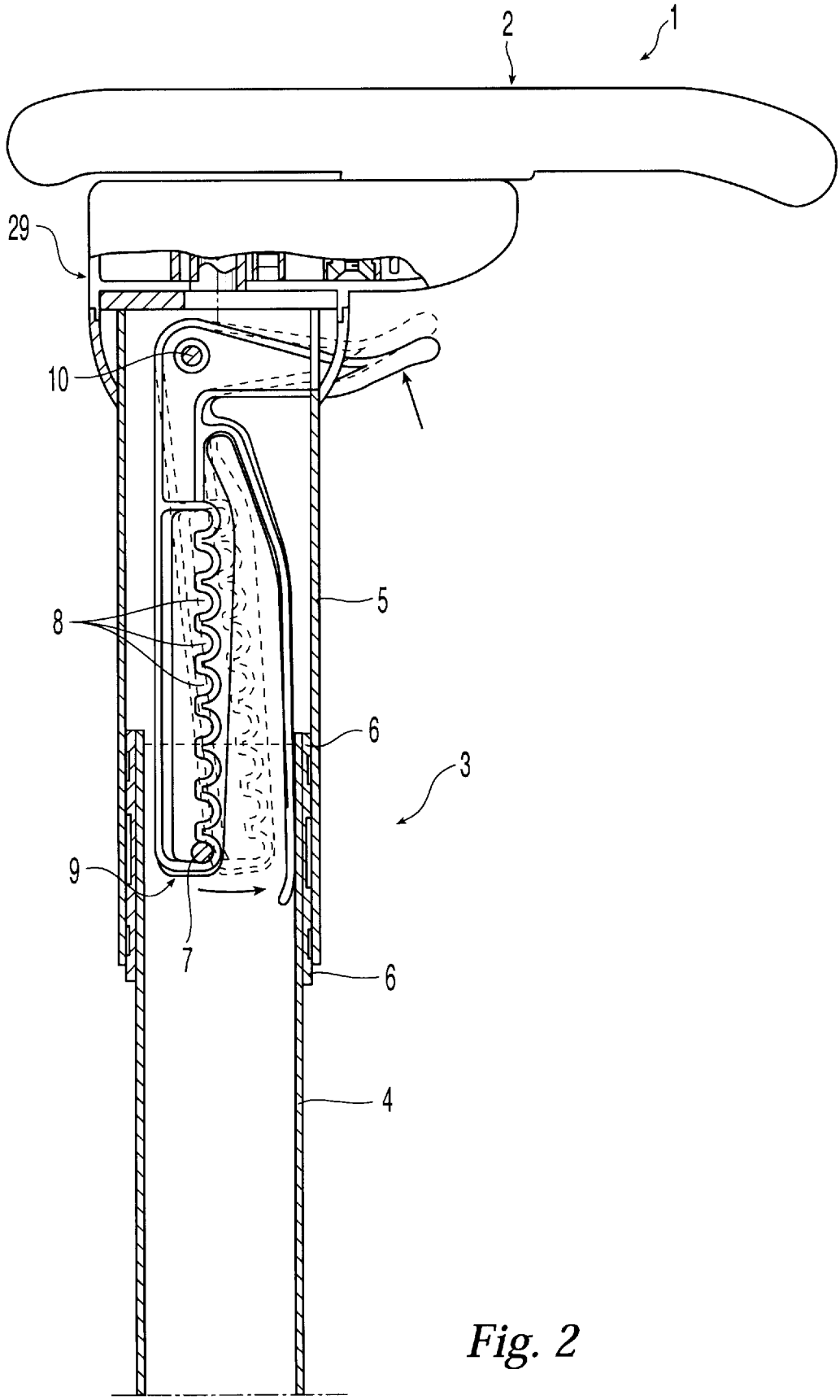
FIG. 2 is a view similar to that of FIG. 1 illustrating the armrest in a position adjusted to a greater height.

With reference to FIGS. 1, 2, numeral 1 generally indicates an armrest for an office chair, comprising an armrest body 2 fitted on the upper extremity of a vertical supporting column 3. The column 3 comprises an internal metal tube 4, which lower end is destined to be connected in any way to the structure of a chair presenting, in the example shown, a relatively flat cross-section, with two opposite flat faces 4*a*, according to a profile which is essentially similar to that indicated with numeral 5 and illustrated with the dotted line in FIG. 3. The profile 5 refers, in fact, to the cross-section of an external tube 5, which is fitted so to slide outside the tube 4. In this way, the supporting column 3 can assume different operative conditions, including a minimum length position, illustrated in FIG. 1, and a maximum length position, illustrated in FIG. 2. The relative sliding movement of the two tubes 4, 5 is guided by means of a plastic material bushing 6, which is externally ensured to the upper extremity of the internal tube 4, and over which the internal surface of the external tube 5 slides. The supporting column 3 is located in the selected condition by engaging a transverse pin 7 connected to the two opposite sides 4*a* for the internal tube 4 in a housing 8, selected from an aligned set of housings made in an arm, for example made of plastic material (also see FIG. 10), which is articulated inside the internal tube 5 by means of a transverse pin 10, fitted between the two opposite flat sides of the external tube 5. The arm 9 incorporates, in a single part, the operating lever 11 for controlling the clockwise rotation of the arm 9 (with reference to FIGS. 1, 3) to the position illustrated with the dotted line in FIG. 2, in such a way to release the pin 7 from the respective housing 8, in which it is engaged so to adjust the height of the armrest. The arm 9 also incorporates, in a single part, an elastic reed 12, which is extended as arm 9 inside the internal tube 4 and is pressed elastically against the internal surface of the tube 4. When the user operates the lever 11 moving it upwards, so to turn the arm 9 towards the released position shown with a dotted line in FIG. 2, it must overcome the elastic resistance of the reed 12, which must return the arm 9 to the engaged position as soon as the user ceases to exert an action on the lever 11. Consequently, to adjust the height of the armrest, the user must pull the lever 11 upwards, against the action of the reed 12, so to release the pin 7 from the housing in which it is engaged, after which the height of the armrest can be adjusted holding the lever operated, so to permit the free movement of the arm 9 with respect to the pin 7. Finally, the lever 11 is released when the required height is reached. In this way, the pin 7 will be received in the closest housing 8, possibly with a slight vertical movement to settle the armrest, under the effect of the recalling action of the reed 12. A front view of the arm 9 is shown in FIG. 10 of the accompanying drawings.

Figure 11:
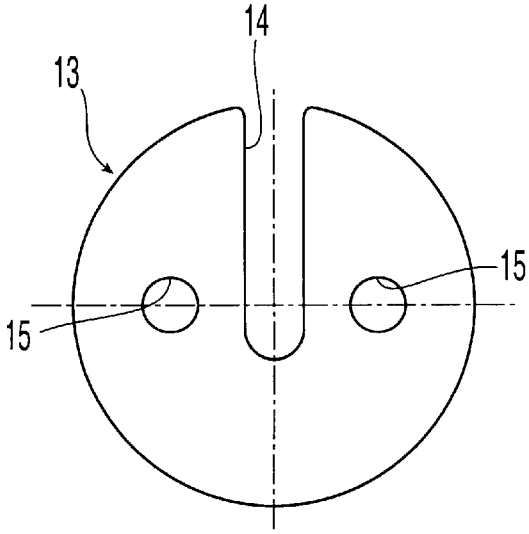
Figure 12:
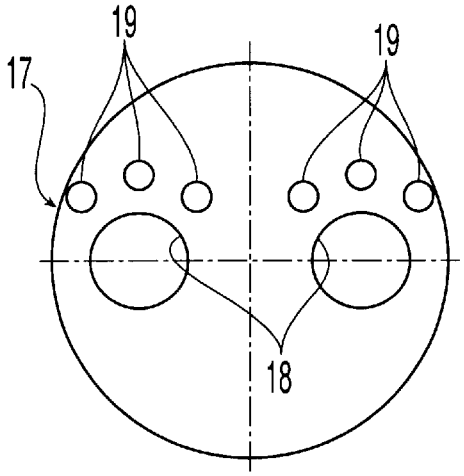

A metal plate 13, which is visible in the plan view in FIG. 11 of the accompanying drawings, is welded to the upper extremity of the external sliding tube 5. The plate 13 comprises a central slot 14 to prevent interference with the lever 11 for releasing the height adjustment of the armrest, and two holes 15 in which two vertical axis pins 16 are welded. A plastic material plate 17 is positioned over the metal plate 13, illustrated in the plan view in FIG. 12, presenting two holes 18 for engaging over the two pins 16, and two sets of three spherical cavities 19, each concentric with respect to the respective hole 18. Furthermore, a hemispherical boot 20 made of plastic material, with a lower aperture encompassing the external tube 5 and an upper mouth 20*a*, is fastened to the upper part of the external tube 5. The boot 20 presents a front slot 20*b* to prevent interference with the armrest height adjustment release lever 11.

Figure 1A:
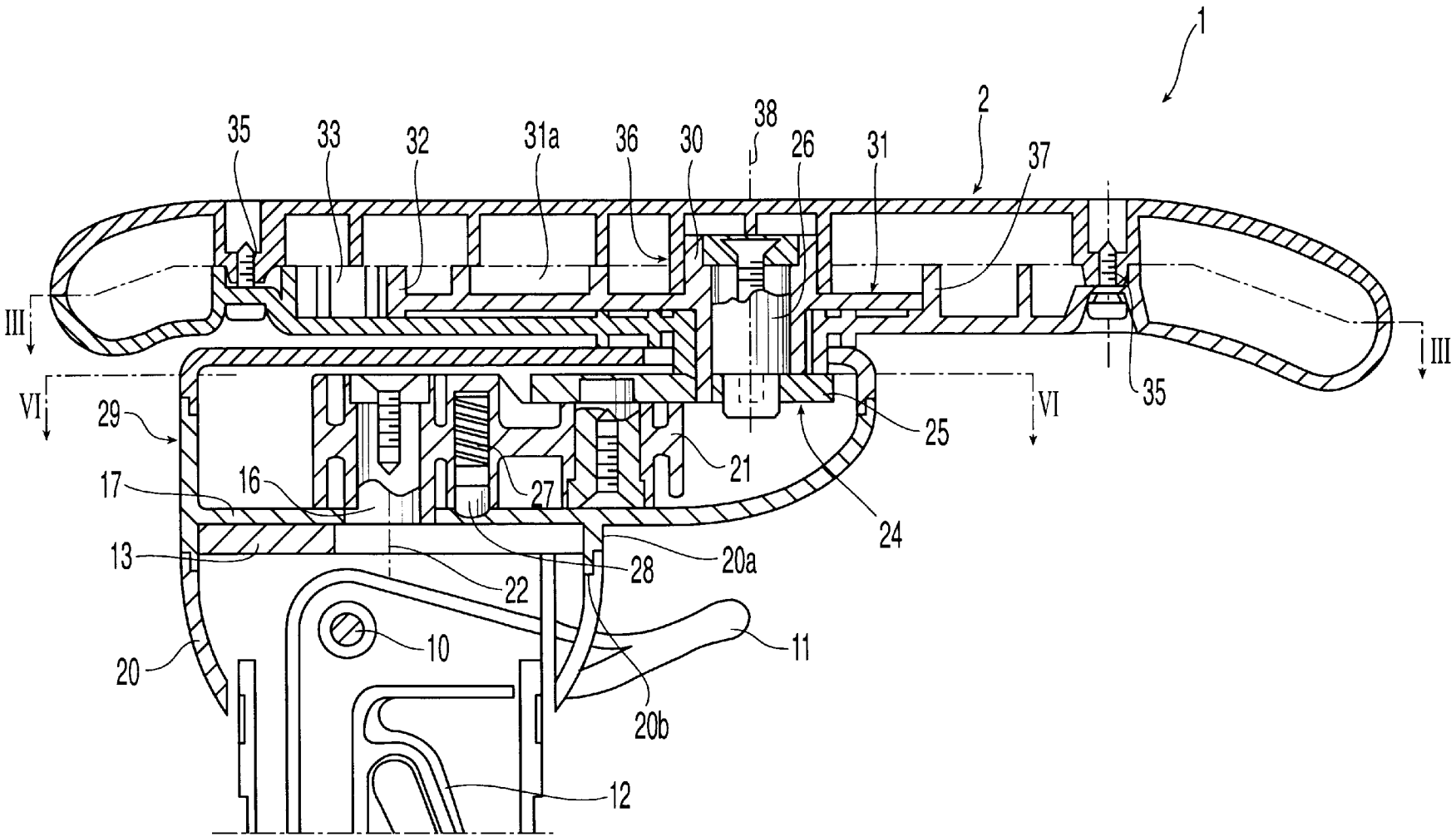
FIG. 1A is a blown-up view of a detail in FIG. 1.
Figure 6:
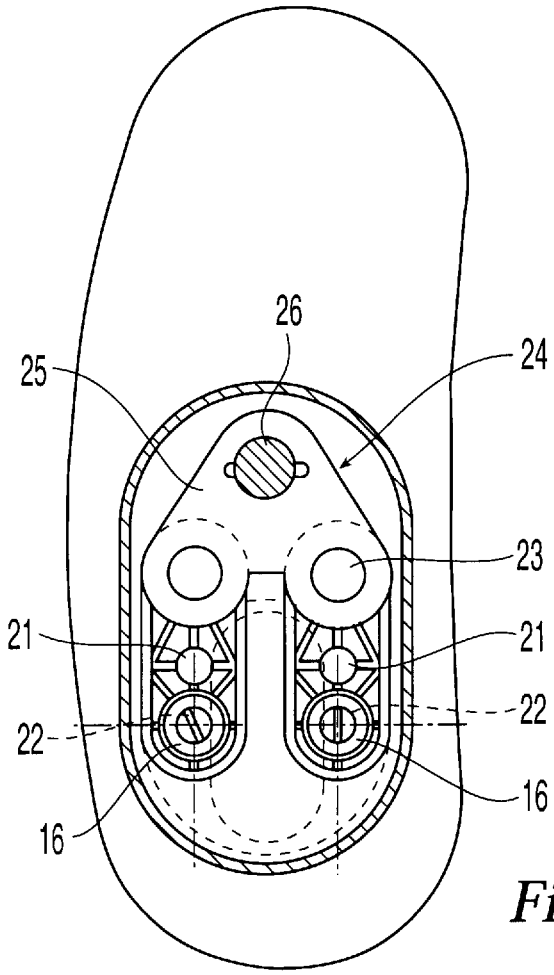
FIG. 6 is a cross-section view according to the line VI—VI in FIG. 1, FIGS. 7, 8 are cross-section, scaled-down views, similar to FIG. 6, showing the armrest body in two different operative positions moved in a perpendicular horizontal direction with respect to the longitudinal direction of the armrest.
Figure 7:
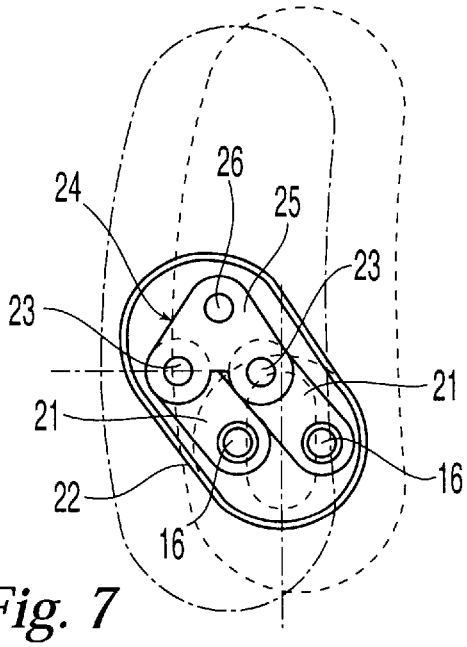
Figure 8:
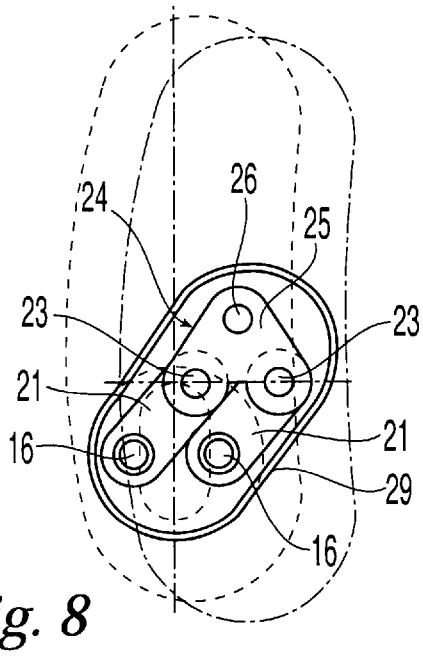

Also with reference to FIGS. 6–8, two respectively parallel articulated arms are fitted so to pivot on the two vertical pins 16, visible in the plan view in FIGS. 6, 7, 8, one of which is visible in the cross-section view in FIG. 1. Each arm 21 consists of a body made of plastic material fitted so to pivot on two pins 16 projecting vertically from the metal plate 13. The reference numerals 22 indicate the axes of the two pins 16. The opposite extremities of the two articulated arms 21 are, in turn, articulated by means of respective pins 23 onto an intermediate supporting element 24, comprising a metal plate 25, which shape is essentially triangular, with one side connected to two articulated arms 21 and a front extremity, which is welded to a vertical pin. The set of two articulated arms 21 consequently forms an articulated parallelogram linkage system, which connects the intermediate supporting element 24 to the plate 13 welded to the upper extremity of the supporting column 3, so that the intermediate supporting element 24 can be moved in the perpendicular horizontal direction with respect to the longitudinal direction of the armrest between two extreme positions, illustrated in FIG. 7 and FIG. 8, respectively. With reference to FIG. 1A, each of the arms 21 presents a vertical cavity 27 opening downwards in which a tip 28 slides. The tip is pushed by a coil spring arranged in the cavity 27 and co-operates with the respective set of three cavities 19 in the plate 17, for providing a precise reference for the intermediate position, illustrated in FIG. 6, and the extremity positions, illustrated in FIGS. 7, 8, of the transverse regulation movement of the intermediate supporting element 24. The articulated parallelogram linkage system consists of two arms 21 and is arranged inside a plastic material box, indicated in general with reference numeral 29, which consists of a lower casing and an upper casing, joined together, and which is fitted so to turn on the upper mouth of the hemispherical boot 20 and around the two plates 13, 17 in such a way to accompany the articulated parallelogram linkage system in its movement, as can clearly be seen in FIGS. 7, 8.

A bushing 30 made of plastic material is fitted so to turn on the vertical pin 26 (which axis is indicated with reference numeral 38) which projects from the upper part of the metal plate 30. The lower part of the bushing presents three axial prongs received in respective cavities by plate 25 so that the bushing 30 is locked in rotation with respect to the plate 25 and the pin 26. The bushing 30 is an integral part of the a plastic casing, including a plate 31, which shape is essentially circular (also see FIGS. 3–5), including a pointed appendix 31*a*, which is an engaging element 32, for co-operating with a plastic material clip 33 (see FIGS. 3–5), jammed in a housing 34 in the plastic material casing forming the body 2 of the armrest. The body 2 consists of two plastic material casings, which are coupled by means of screws 35. The upper plate presents a tubular internal appendix 36, which is fitted so to turn on an extremity of the bushing 30 projecting from the upper part of the plate 31. Furthermore, the part of the casing forming the armrest body 2 presents a circular circumference side 37 (see FIGS. 1 and 3–5), extending approximately by approximately 270 degrees, which surrounds the circular edge of the plate 31, and which thus acts as a fulcrum for the oscillation of the armrest body 2 on the axis 38 of the pin 26. This axis is positioned essentially perpendicularly to the centre of the armrest, at distances which are essentially equal to that of the two extremities of the armrest (also if, naturally, a different positioning of the axis 38 with respect to the armrest is possible). In correspondence of the appendix 31*a* of the plate 31, the extremities of the side 37 extend with two parallel sides 39, which are sufficiently distanced to prevent interference with the appendix 31*a* in the two extreme turned positions of the armrest 2 to the left and to the right (FIGS. 4, 5).

Figure 3:
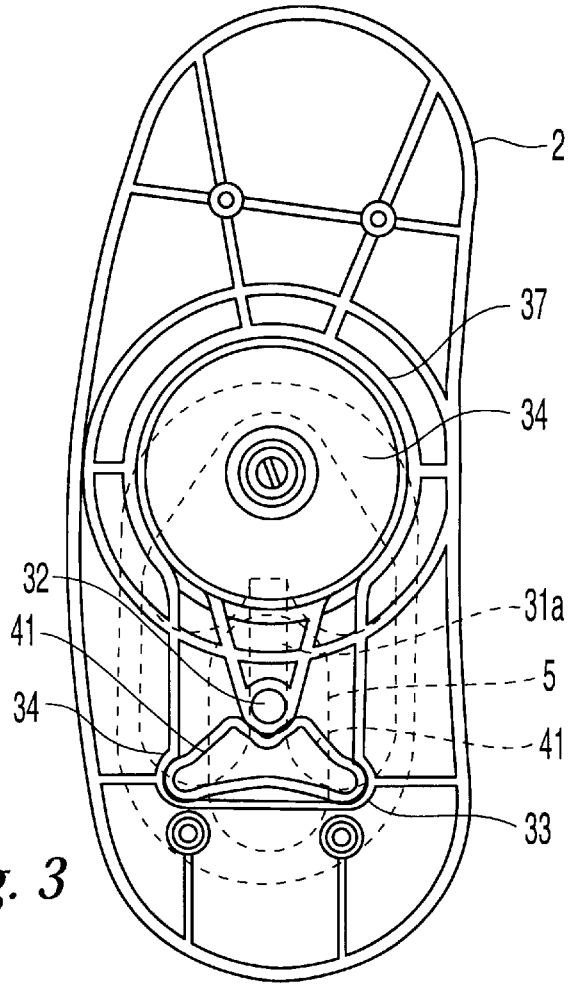
FIG. 3 is a cross-section view according to the line III—III in FIG. 1, FIGS. 4, 5 are cross-section, scaled-down views, similar to FIG. 3, showing the armrest body in two different operative positions turned on the horizontal plane.
Figure 4:
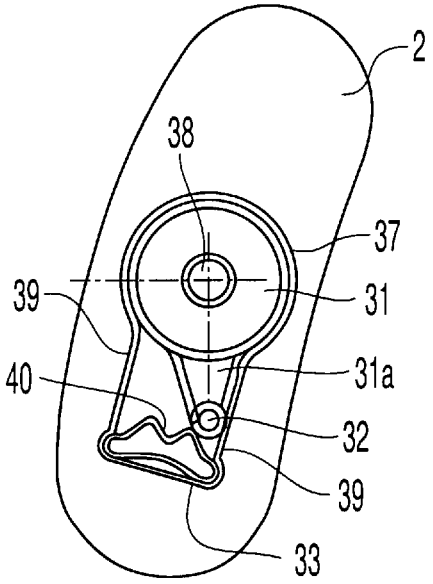
Figure 5:
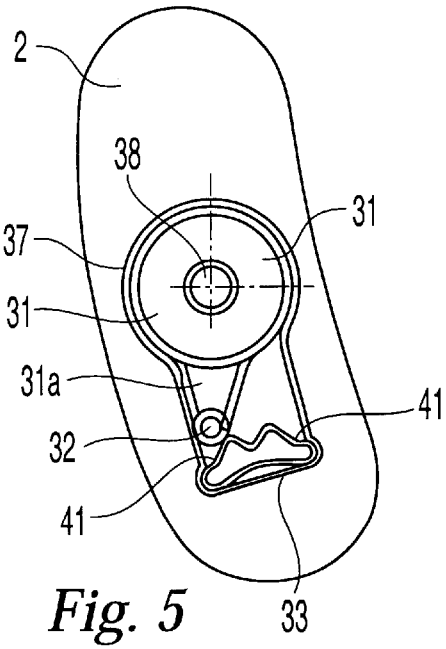

The clip 33 consists of a plastic material rod wrapped to form a closed ring, defining a central housing 40, which receives the engaging element 32 in the neutral position not turned in the armrest body 2 visible in FIG. 3, and two lateral sides 41, which co-operate with the two sides 39 for receiving the engaging element 32 in the two extreme turned positions to the right and to the left of the armrest body 2, respectively (see FIGS. 4, 5).

In this description, it appears obvious that the armrest body 2 can be adjusted in the vertical direction, by sliding of the external tube 5 in the internal tube 4 and locked by means of the locking device 7, 9, described above, and in the horizontal direction, transversely with respect to longitudinal direction of the armrest, thanks to the orientation of the articulated parallelogram linkage system consisting of the arms 21 (see FIGS. 7, 8). Furthermore, for each position of the armrest in height, and for any position of the intermediate supporting element 24 (consisting of the plate 25, the pin pivoting on the axis 38), between the two extreme positions which are illustrated in FIGS. 4, 5.

Figure 9:
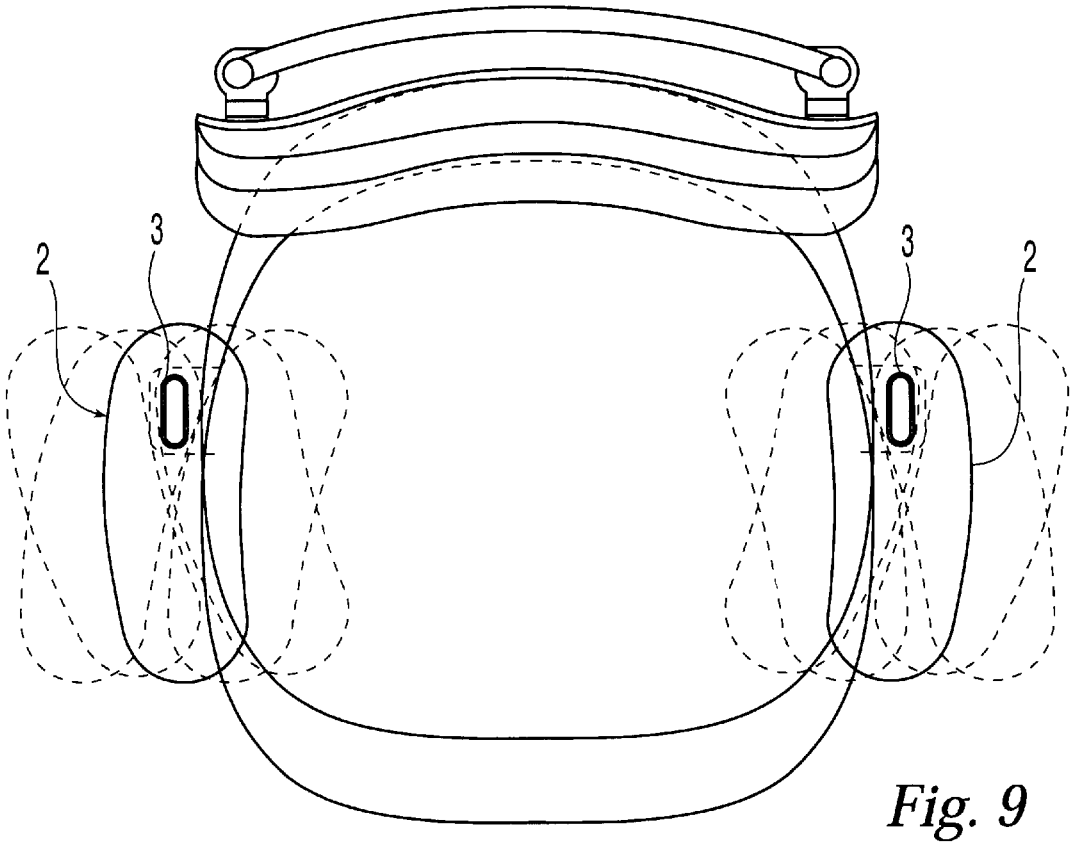
FIG. 9 is a plan view of a chair using two armrests according to this invention.

FIG. 9 shows a plan view of the a chair according to this invention, incorporating a pair of armrests of the type described above. The dotted lines illustrate all the positions which the armrests can assume. As can be seen, each armrest can be moved transversally between two extreme positions. Furthermore, in each of said extreme positions, and in the intermediate neutral position, each armrest can be oriented by means of oscillations on the axis 38 so to assume an orientation, which is straight or turned either leftwards or rightwards.

Thanks to these characteristics, the user can adapt the armrests optimally according to the needs deriving from the user's build and the specific activity to be carried out (for example, a relaxing position or a position for working on a keyboard).

Naturally, numerous changes can be implemented to the construction and forms of embodiment of the invention herein envisaged, all comprised within the context of the concept characterising this invention, as defined by the following claims.

What is claimed is:

1. Armrest for chair comprising a supporting column and an armrest body connected to an upper extremity of the supporting column and defining a longitudinal direction of the armrest, wherein:

the armrest body pivots on a first axis which is essentially vertical on an intermediate supporting element and can assume various operative angular positions around said first axis, the intermediate supporting element is connected to the armrest supporting column so as to move in a direction which is essentially transverse and horizontal with respect to the longitudinal direction of the armrest, so that the latter can also be positioned in various operative positions with respect to the supporting column, transversely with respect to the longitudinal direction of the armrest, and said intermediate supporting element is connected to the supporting column by means of an articulated vertical axis parallelogram linkage system, which can pivot between two opposite extreme positions.

2. Armrest according to claim 1, wherein devices for defining at least two extreme angular position of the armrest body, turned in opposite directions around said first vertical axis, in addition to an unturned neutral position, are arranged between the armrest body and the intermediate supporting element.

3. Armrest according to claim 1, wherein the articulated parallelogram linkage system comprises a pair of arms articulated both on two parallel vertical axes on the supporting column and on two parallel vertical axes of said intermediate supporting element.

4. Armrest according to claim 3, wherein a plate is welded to the upper extremity of the supporting column, onto which two parallel pins for supporting and pivoting the two articulated arms forming said articulated parallelogram linkage system, said system being contained in a plastic material casing which is fitted so as to turn on said plate.

5. Armrest according to claim 4, wherein each of said arms in the articulated parallelogram system is equipped with an elastic tip for co-operating with corresponding cavities arranged in a plastic material plate fitted over said metal material plate to define the operative positions of said articulated parallelogram system.

6. Armrest according to claim 3, wherein the intermediate supporting element includes an engaging element, which is made to co-operate with an elastic element connected to the armrest body for defining the operative angular positions of the armrest body around said first axis.

7. Armrest according to claim 6, wherein said intermediate supporting element comprises a metal plate connected to said articulated parallelogram system and connected to a vertical pin, in addition to a plastic material bushing fitted over said pin and fastened in rotation over said plate, said plastic material bushing being an integral part of a horizontal plate, which is essentially circular, over which a plastic material casing is fitted so to turn, the casing forming an armrest body; said plastic material plate being essentially circular and comprising an appendix ending with said element for engaging said elastic element for providing a reference of the operative positions of the armrest around said first axis.

8. Armrest according to claim 7, wherein said essentially circular plastic material plate is surrounded by a circular side belonging to a plastic material casing forming the armrest body, said circular side extending for an arch of approximately 270 degrees with its extremities extended and forming two parallel distanced sides.

9. Armrest according to claim 8, wherein said elastic element co-operating with said engaging element to define the operative positions of the armrest body around the first axis consists of a closed ring ribbon made of plastic material, defining a central housing and two sides co-operating with said parallel sides (39) to define housings for receiving the engaging element in a central position and in extreme turned positions of the armrest.

10. Armrest according to claim 1, wherein said supporting column can be adjusted in height.

11. Armrest according to claim 10, wherein the supporting column comprises two coaxial tubes sliding one inside the other, equipped with manually releasable fastening devices, for selectively fastening the two coaxial tubes in a plurality of different operative positions.

12. Armrest according to claim 11, wherein said fastening devices comprise an arm articulated on an external coaxial tube and connected rigidly to an operating lever, said arm presenting a plurality of housings for co-operating with a transverse pin connected to an internal tube, said arm being integral with an elastic reed tending to hold the arm in the engaged positioned of one of said housings over said pin connected to the internal tube.

13. Chair, wherein it comprises at least one armrest according to claim 1.

* * * * *